United States Patent [19]

McCanse

[11] Patent Number: 5,022,119

[45] Date of Patent: Jun. 11, 1991

[54] HEAVY DUTY HINGE

[76] Inventor: James E. McCanse, 949 Etnyre Terrace Rd., Oregon, Ill. 61061

[21] Appl. No.: 416,862

[22] Filed: Oct. 4, 1989

[51] Int. Cl.[5] ..... E05D 5/02

[52] U.S. Cl. ..... 16/387; 16/253

[58] Field of Search ..... 16/387, 372, 253

[56] References Cited

U.S. PATENT DOCUMENTS

| | | | |
|---|---|---|---|
| 1,309,730 | 7/1919 | Haskell | 16/372 |
| 2,651,806 | 9/1953 | Thompson | 16/253 |
| 2,763,890 | 9/1956 | Cox | 16/253 |
| 4,141,107 | 2/1979 | Sheiman et al. | 16/387 |
| 4,729,149 | 3/1988 | Brunkan | 16/253 |

FOREIGN PATENT DOCUMENTS

| | | | |
|---|---|---|---|
| 2109916 | 9/1972 | Fed. Rep. of Germany | 16/387 |
| 2251970 | 5/1973 | Fed. Rep. of Germany | 16/387 |
| 3027700 | 2/1982 | Fed. Rep. of Germany | 16/387 |
| 2184775 | 7/1987 | United Kingdom | 16/302 |

*Primary Examiner*—Robert L. Spruill
*Assistant Examiner*—Carmine Cuda
*Attorney, Agent, or Firm*—Leydig, Voit & Mayer

[57] ABSTRACT

A heavy duty industrial or agricultural hinge for pivotally interconnecting two members, the hinge including a rod adapted to extend through interleaved ears affixed to the members. In order to establish adequate lateral clearance at the hinge joint, each ear is formed with a half round-half rectangular configuration which serves to automatically space the bearing portion of the ear a proper distance away from the hinged member. An arcuate insert is fixed within the ear and coacts with the half round portion of the ear to form a generally cylindrical bearing portion for the hinge rod.

10 Claims, 2 Drawing Sheets

HEAVY DUTY HINGE

BACKGROUND OF THE INVENTION

This invention relates generally to a hinge and, more particularly, to a heavy duty hinge for use with industrial or agricultural equipment. By way of example, the hinge may be used to pivotally interconnect two decks of a flex wing mower.

Such a hinge is usually formed by welding short lengths of pipe or tubing along each deck to form spaced ears along the deck. The ears of the two decks then are interleaved and are connected by a heavy steel rod which forms a hinge pin.

As a practical matter, there is substantial radial clearance between the ears and the rod. When one deck pivots relative to the other, the radial clearance allows the ears of the tipped deck to move toward the other deck and rub against such deck rather than pivoting on the rod. This causes unacceptable drag, abrasion and wear.

To avoid the problem outlined above, it has been common practice to weld small rods to the deck in order to space the tubular ears away from the deck and thereby avoid interference during pivoting of the decks. This involves handling, assembly and welding of extra pieces and produces excessive weld heat and distortion. In many cases, the warpage is such that the assembly must be straightened after the welding has been completed.

SUMMARY OF THE INVENTION

The general aim of the present invention is to provide new and improved heavy duty hinge ears which may be welded directly to the hinged members and which, as an incident to such welding, automatically space the hinged members apart sufficiently far as to prevent the members from rubbing together during pivoting even though substantial radial clearance exists between the ears and the hinge rod.

A more detailed object of the invention is to achieve the foregoing by providing hinge ears which are uniquely shaped to space the hinge axis away from the hinged member while still providing a solid and durable bearing for the hinge rod.

In a still more specific sense, the invention resides in a half round-half rectangular hinge ear having a relatively hard insert that forms a bearing for the hinge rod.

The invention also is characterized by the relatively simple construction of the hinge ears with the hard inserts.

These and other objects and advantages of the invention will become more apparent from the following detailed description when taken in conjunction with the accompanying drawings.

DETAILED DESCRIPTION OF THE PREFERRED EMBODIMENTS

Figure 1:
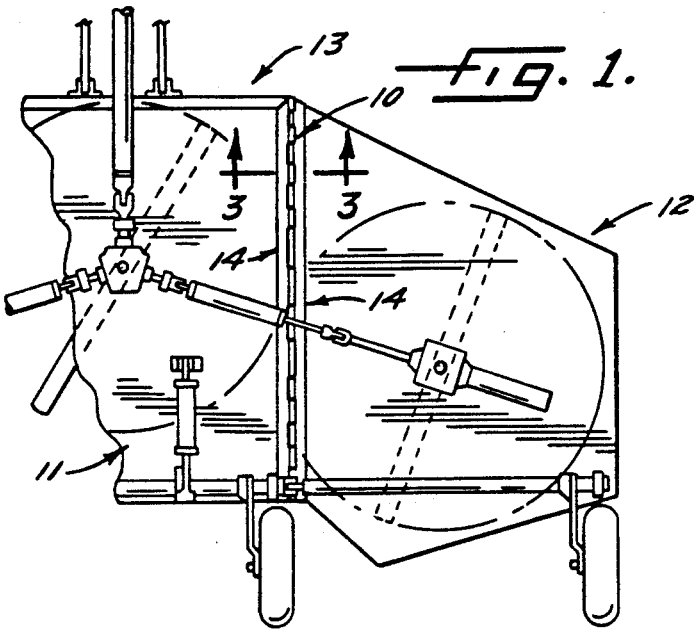
FIG. 1 is a fragmentary top plan view of a typical agricultural implement equipped with a new and improved hinge incorporating the unique features of the present invention.
Figure 2:
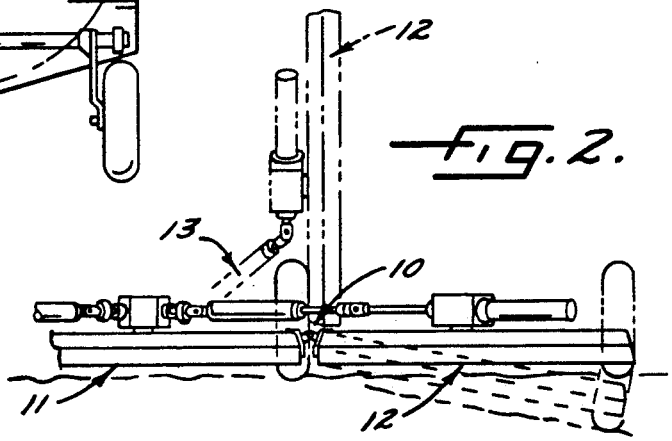
FIG. 2 is a fragmentary rear elevational view of the implement.

For purposes of illustration, the invention has been shown in the drawings as embodied in a heavy duty hinge 10 for connecting two members 11 and 12 for relative pivoting. While the hinge may be used in various industrial and agricultural applications, it has been shown specifically in conjunction with a flex wing mower 13 in which the two hinged members 11 and 12 are a center mower deck and an outboard mower deck, respectively. Each deck includes a sheet metal hinge mounting member 14 having a horizontal top wall 15 and a depending skirt 16.

Figure 4:
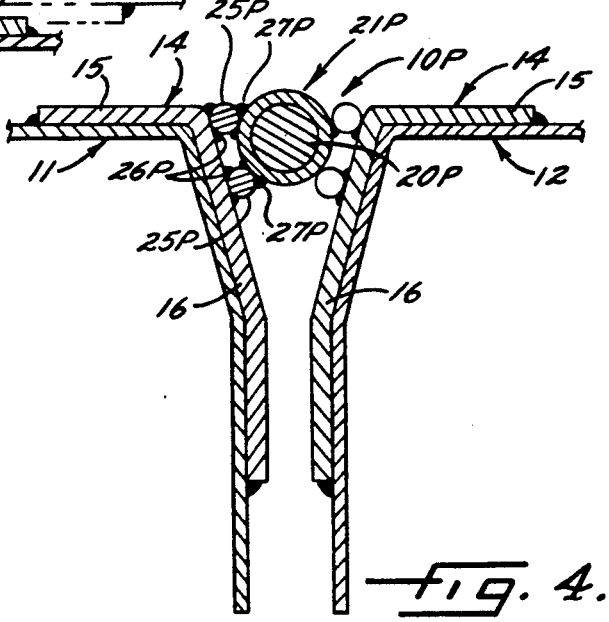
Fig. 4. (PRIOR ART)
FIG. 4 is a view similar to FIG. 3 but shows a typical prior art hinge.

A typical prior art hinge 10P is shown in FIG. 4. Such a hinge includes a cylindrical hinge pin or rod 20P which extends fore-and-aft of the decks 11 and 12 and which is centered laterally between the decks. The rod 20P extends through interleaved ears 21P which are fixed to the skirts 16 of the hinge mounting members 14 of the decks. Typically, the ears are made of short lengths of metal pipe or tubing which are spaced along the decks, the ears of one deck being staggered with respect to the ears of the other deck so that the two sets of ears may interleave with one another.

Because the heavy duty hinge 10P is not a precisely manufactured item, significant radial clearance exists between the hinge rod 20P and the ears 21P. Thus, there is considerable "slop" at the hinge joint as the deck 12 pivots relative to the deck 11. During such pivoting, the hinge rod 20P shifts radially in the ears 21P and, unless steps are taken to accommodate such shifting, the ears of one deck will bind and abrade against the skirt 16 of the hinge mounting member 14 of the other deck. The conventional way of preventing such binding and abrading is to secure each ear 21P to its respective hinge mounting member 14 with two short rods 25P which space the ear laterally away from the skirt 16 of the hinge mounting member in order to provide lateral clearance for the ears of the other deck. It is necessary to secure each spacer rod 25P to the skirt 16 with a weld 26P and then to secure the ear to the spacer rod with another weld 27P. Assembly and welding of the spacer rods is time-consuming and, in addition, considerable heat is generated during the welding operation. Such heat tends to warp the hinge mounting member 14 and, in some cases, the distortion is so severe that a straightening operation is necessary after the assembly has been completed.

The present invention contemplates the provision of a hinge 10 with uniquely shaped ears 21 which avoid the need for spacer rods or the like but which still establish adequate lateral clearance to enable free pivoting of the decks 11 and 12. Each ear 21 is characterized in that it includes a laterally elongated portion which performs a spacing function and also includes a round portion which serves as a bearing for the hinge rod 20.

Figure 3:
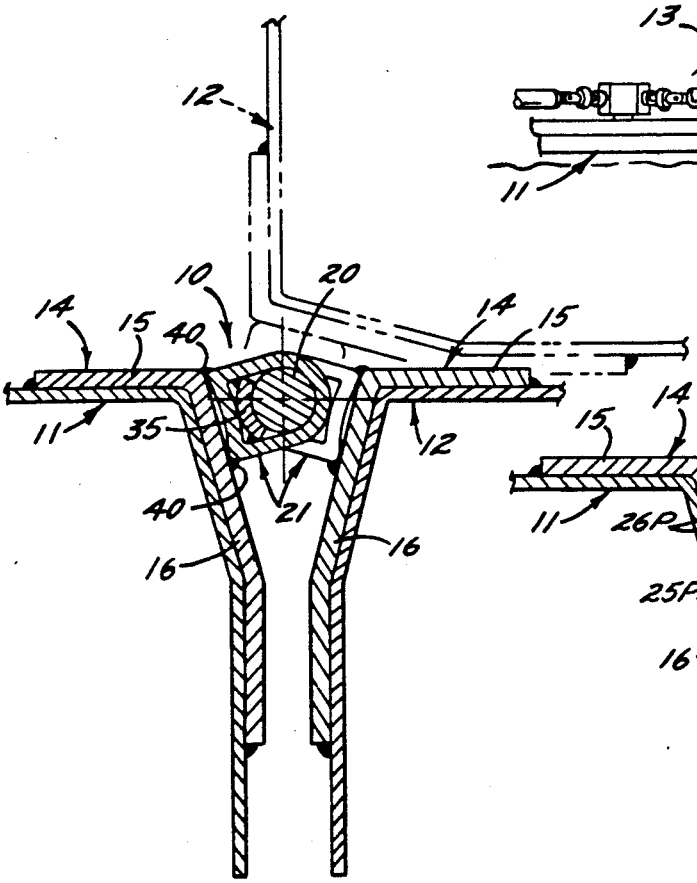
FIG. 3 is an enlarged fragmentary cross-section taken substantially along the line 3—3 of FIG. 2.
Figure 5:
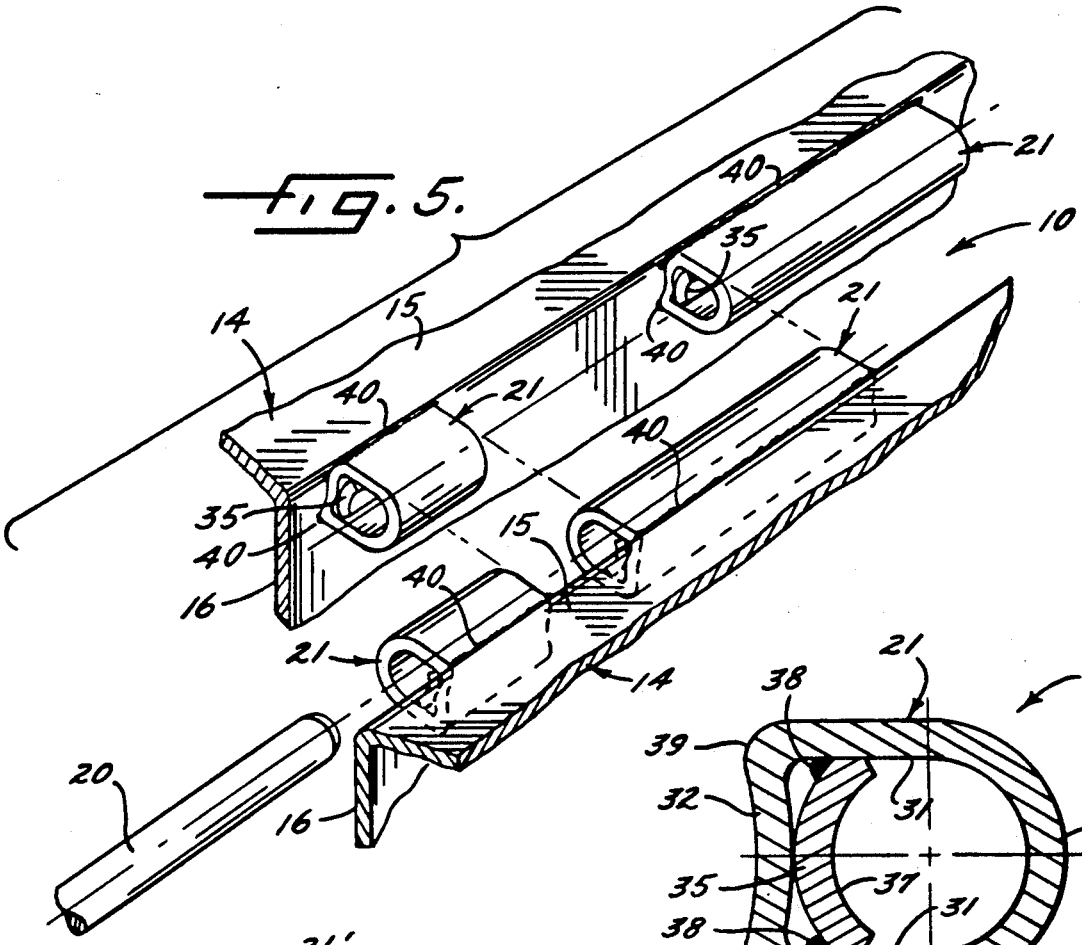
FIG. 5 is an exploded perspective view of one section of the hinge of the invention.
Figure 6:
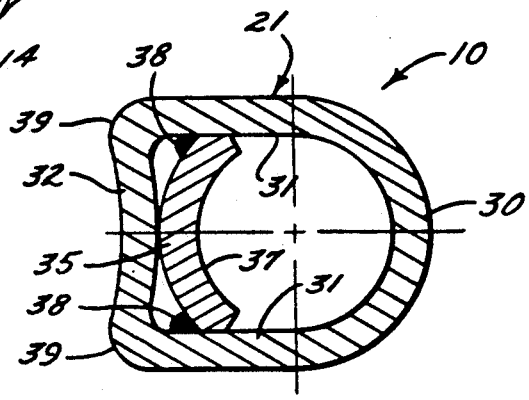
FIG. 6 is an enlarged cross-section taken radially through one of the ears of the hinge of the invention.

More specifically, each of the ears 21 of the hinge 10 of the embodiment shown in FIGS. 3, 5 and 6 is made from a short length of soft steel tubing or pipe which originally is of conventional circular cross-section. In carrying out the invention, the initially circular pipe is deformed into the half round-half rectangular shape shown in FIG. 6. Thus, the ear 21 includes an arcuate section 30 extending through approximately 180 degrees and having a convexly arcuate exterior surface and a concavely arcuate interior surface. Extending laterally from the ends of the arcuate section 30 are two straight and parallel sections 31 whose interior surfaces extend tangentially from the ends of the interior surface of the arcuate section. A bridge section 32 extends continuously between the distal ends of the straight sections 31 and its interior surface extends substantially perpendicular to the interior surfaces of the straight sections. While the bridge section 32 could be straight, it is curved slightly in this particular instance and is formed with a concave exterior surface and a convex interior surface.

Each ear 21 is completed by a separate insert 35 (FIG. 6) which is fixed within the ear adjacent the bridge section 32. The insert includes an arcuately concave surface 37 which faces the arcuate section 30 and which coacts therewith to define a bearing for the hinge rod 20. Preferably, the insert is made of relatively hard metal such as high carbon steel. During pivoting of the decks 11 and 12, the heaviest loading occurs against the insert and thus the ear 21 possesses good wear characteristics even though the tubular component 30, 31, 32 is made of relatively soft and inexpensive tubing or even standard black pipe.

The insert 35 of each ear 21 is placed into the ear while the latter is still circular. When the ear is deformed, the insert becomes captivated with a press fit between the straight sections 31 and against the bridge section 32. If desired, the ends of the insert may be tack welded at 38 to the interior surfaces of the straight sections 31, either as an alternative to the press fit or in addition thereto.

As shown in FIG. 6, a small radiused corner 39 is formed at the junction of the bridge section 32 with each straight section 31. When the ear 21 is attached to the skirt 16 of the mounting member 14, welds 40 are made along the two corners 39 of the ear as shown in FIGS. 3 and 5. Only one weld 40 is required along each side of the ear, and the small corners 39 enable the welds to be formed quickly and easily.

Figure 7:
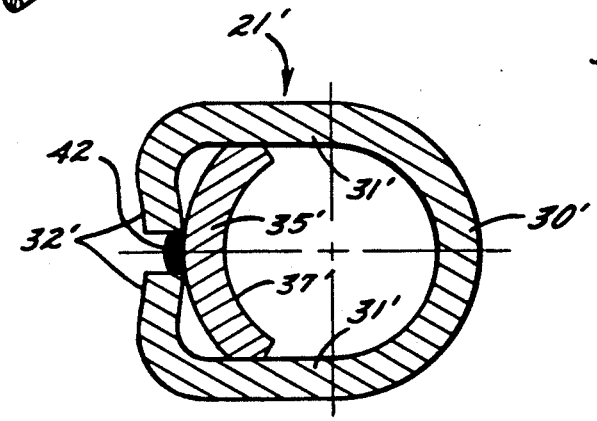
FIG. 7 is a view similar to FIG. 6 but shows a modified hinge ear.

A modified ear 21' is shown in FIG. 7 and is the same as the ear 21 except that the ear 21' is made from a flat piece of strip stock which is bent into substantially the same shape as the ear 21. The bridge 32' of the ear 21' is discontinuous and includes spaced ends which are located in close proximity to one another. A weld 42 is located between the spaced ends and attaches the insert 35' to the bridge 32'. The weld 42 may be conveniently made from outside of the ear and, if desired, may extend along the entire length of the ear. The weld also keeps the ends of the bridge from pulling apart.

From the foregoing, it will be apparent that the present invention brings to the art a new and improved hinge 10, 10' in which each ear 21, 21' is shaped so as to automatically space the bearing portion of the hinge away from the deck 11, 12 when the ear is installed. This not only reduces the installation time and effort but also reduces weld heat and distortion.

I claim:

1. A hinge ear for receiving a cylindrical hinge pin and comprising a one piece tubular component having an arcuate section with an arcuately concave interior surface and an arcuately convex exterior surface, said arcuate section extending through a span of about 180 degrees and having two end portions, two substantially parallel and substantially straight sections formed integrally with the end portions of said arcuate section and having substantially straight interior surfaces which extend substantially tangentially from the interior surface of said arcuate section adjacent the end portions thereof, a bridge section formed integrally with said straight sections and having an interior surface which extends substantially perpendicular to the interior surfaces of said straight sections, and a separate insert fixed within said component adjacent said bridge section and having an arcuately concave surface which faces the concave interior surface of said arcuate section and which coacts therewith to define a substantially cylindrical bearing surface for said hinge pin.

2. A hinge ear as defined in claim 1 in which said tubular component is made of relatively soft steel, said insert being made of harder steel.

3. A hinge ear as defined in claim 2 in which said insert is tack welded to said straight sections.

4. A hinge ear as defined in claim 1 in which said insert is captivated with a press fit between said straight sections and against said bridge section.

5. A hinge ear as defined in claim 4 in which said insert is also tack welded to said straight sections.

6. A hinge ear as defined in claim 1 in which said bridge section extends continuously between said straight sections.

7. A hinge ear as defined in claim 6 in which said component is formed from an originally cylindrical piece of pipe which is deformed in order to form said straight sections and said bridge section.

8. A hinge ear as defined in claim 1 in which said bridge section includes two portions, said two portions of said bridge section extending from said two straight sections and having opposing ends located closely adjacent one another.

9. A hinge ear as defined in claim 8 in which a weld attaches said insert to said bridge section, said weld being located between the opposing ends of said bridge section.

10. The combination of, first and second members, and a hinge for pivotally connecting said members to one another, said hinge comprising a series of ears spaced along each member and interleaved with the ears of the other member and further comprising a cylindrical hinge rod extending through said ears, said combination being characterized in that each of said ears comprises a one piece tubular component having an arcuate section with an arcuately concave interior surface and an arcuately convex exterior surface, said arcuate section extending through a span of about 180 degrees and having two end portions, two substantially parallel and substantially straight sections formed integrally with the end portions of said arcuate section and having substantially straight interior surfaces which extend substantially tangentially from the interior surface of said arcuate section adjacent the end portions thereof, a bridge section formed integrally with said straight sections and having an interior surface which extends substantially perpendicular to the interior surfaces of said straight sections, said tubular component being welded to the associated member adjacent the junctions of said straight sections with said bridge section, and a separate insert fixed within said component adjacent said bridge section and having an arcuately concave surface which faces the concave interior surface of said arcuate section and which coacts therewith to define a substantially cylindrical bearing surface for said hinge rod.

* * * * *